US011398679B2

(12) United States Patent
Chuang et al.

(10) Patent No.: US 11,398,679 B2
(45) Date of Patent: Jul. 26, 2022

(54) ANTENNA STRUCTURE

(71) Applicant: Wistron Corp., New Taipei (TW)

(72) Inventors: Nien-Chao Chuang, New Taipei (TW); Pei-Cheng Hu, New Taipei (TW)

(73) Assignee: WISTRON CORP., New Taipei (TW)

( * ) Notice: Subject to any disclaimer, the term of this patent is extended or adjusted under 35 U.S.C. 154(b) by 36 days.

(21) Appl. No.: 17/132,191

(22) Filed: Dec. 23, 2020

(65) Prior Publication Data

US 2022/0173511 A1 Jun. 2, 2022

(30) Foreign Application Priority Data

Nov. 27, 2020 (TW) ..... 109141722

(51) Int. Cl.
*H01Q 1/38* (2006.01)
*H01Q 5/307* (2015.01)
*H01Q 9/42* (2006.01)

(52) U.S. Cl.
CPC ..... *H01Q 5/307* (2015.01); *H01Q 1/38* (2013.01); *H01Q 9/42* (2013.01)

(58) Field of Classification Search
CPC ..... H01Q 9/42; H01Q 1/38; H01Q 5/307
See application file for complete search history.

(56) References Cited

U.S. PATENT DOCUMENTS

2012/0001815 A1* 1/2012 Wong ..... H01Q 9/0421 343/843

OTHER PUBLICATIONS

Chinese Language Office Action dated Jul. 15, 2021 in the corresponding application TW 109141722.

* cited by examiner

*Primary Examiner* — Graham P Smith
(74) *Attorney, Agent, or Firm* — McClure, Qualey & Rodack, LLP

(57) ABSTRACT

An antenna structure includes a first radiation element, a second radiation element, a third radiation element, a fourth radiation element, a fifth radiation element, and a nonconductive support element. The first radiation element has a feeding point. The second radiation element is coupled to the feeding point. The third radiation element has a grounding point. The fourth radiation element is coupled to the third radiation element. The fourth radiation element is adjacent to the first radiation element and the second radiation element. The fifth radiation element is coupled to the third radiation element and the fourth radiation element. The first radiation element, the second radiation element, the third radiation element, the fourth radiation element, and the fifth radiation element are disposed on the nonconductive support element.

19 Claims, 3 Drawing Sheets

ANTENNA STRUCTURE

CROSS REFERENCE TO RELATED APPLICATIONS

This application claims priority of Taiwan Patent Application No. 109141722 filed on Nov. 27, 2020, the entirety of which is incorporated by reference herein.

BACKGROUND OF THE INVENTION

Field of the Invention

The disclosure generally relates to an antenna structure, and more particularly, it relates to a wideband antenna structure.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, 2500 MHz, and 2700 MHz. Some devices cover a small wireless communication area; these include mobile phones using Wi-Fi and Bluetooth systems and using frequency bands of 2.4 GHz, 5.2 GHz, and 5.8 GHz.

Antennas are indispensable elements for wireless communication. If an antenna used for signal reception and transmission has insufficient bandwidth, it will negatively affect the communication quality of the mobile device. Accordingly, it has become a critical challenge for antenna designers to design a small-size, wideband antenna element.

BRIEF SUMMARY OF THE INVENTION

In an exemplary embodiment, the disclosure is directed to an antenna structure that includes a first radiation element, a second radiation element, a third radiation element, a fourth radiation element, a fifth radiation element, and a nonconductive support element. The first radiation element has a feeding point. The second radiation element is coupled to the feeding point. The third radiation element has a grounding point. The fourth radiation element is coupled to the third radiation element. The fourth radiation element is adjacent to the first radiation element and the second radiation element. The fifth radiation element is coupled to the third radiation element and the fourth radiation element. The first radiation element, the second radiation element, the third radiation element, the fourth radiation element, and the fifth radiation element are disposed on the nonconductive support element.

In some embodiments, the antenna structure covers a first frequency band, a second frequency band, and a third frequency band. The first frequency band is from 728 MHz to 960 MHz. The second frequency band is from 1805 MHz to 2200 MHz. The third frequency band is from 2300 MHz to 2690 MHz.

In some embodiments, the first radiation element substantially has a U-shape.

In some embodiments, the first radiation element is a variable-width structure and includes a first widening portion and a second widening portion.

In some embodiments, the length of the first radiation element is from 0.1 to 0.2 wavelength of the highest frequency of the first frequency band.

In some embodiments, the second radiation element substantially has a straight-line shape.

In some embodiments, the length of the second radiation element is from 0.05 to 0.2 wavelength of the highest frequency of the third frequency band.

In some embodiments, the third radiation element substantially has an L-shape.

In some embodiments, the fourth radiation element is a meandering structure.

In some embodiments, a first coupling gap is formed between the fourth radiation element and the first radiation element. The width of the first coupling gap is from 0.1 mm to 1 mm.

In some embodiments, a second coupling gap is formed between the fourth radiation element and the second radiation element. The width of the second coupling gap is from 0.1 mm to 1 mm.

In some embodiments, the total length of the third radiation element and the fourth radiation element is from 0.1 to 0.2 wavelength of the lowest frequency of the first frequency band.

In some embodiments, the fifth radiation element substantially has an L-shape.

In some embodiments, the total length of the third radiation element and the fifth radiation element is from 0.1 to 0.3 wavelength of the lowest frequency of the second frequency band.

In some embodiments, the antenna structure further includes a sixth radiation element coupled to the feeding point. The sixth radiation element is substantially perpendicular to the first radiation element and the second radiation element.

In some embodiments, the sixth radiation element substantially has a straight-line shape.

In some embodiments, the antenna structure further includes a seventh radiation element coupled to a first connection point on the fourth radiation element. The seventh radiation element is adjacent to the first widening portion and the second widening portion of the first radiation element.

In some embodiments, the seventh radiation element substantially has an L-shape.

In some embodiments, the antenna structure further includes an eighth radiation element coupled to a second connection point on the fourth radiation element. The eighth radiation element is substantially perpendicular to the fourth radiation element.

In some embodiments, the first radiation element, the second radiation element, the third radiation element, the fourth radiation element, and the fifth radiation element are disposed on the nonconductive support element by using LDS (Laser Direct Structuring) technology.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1:
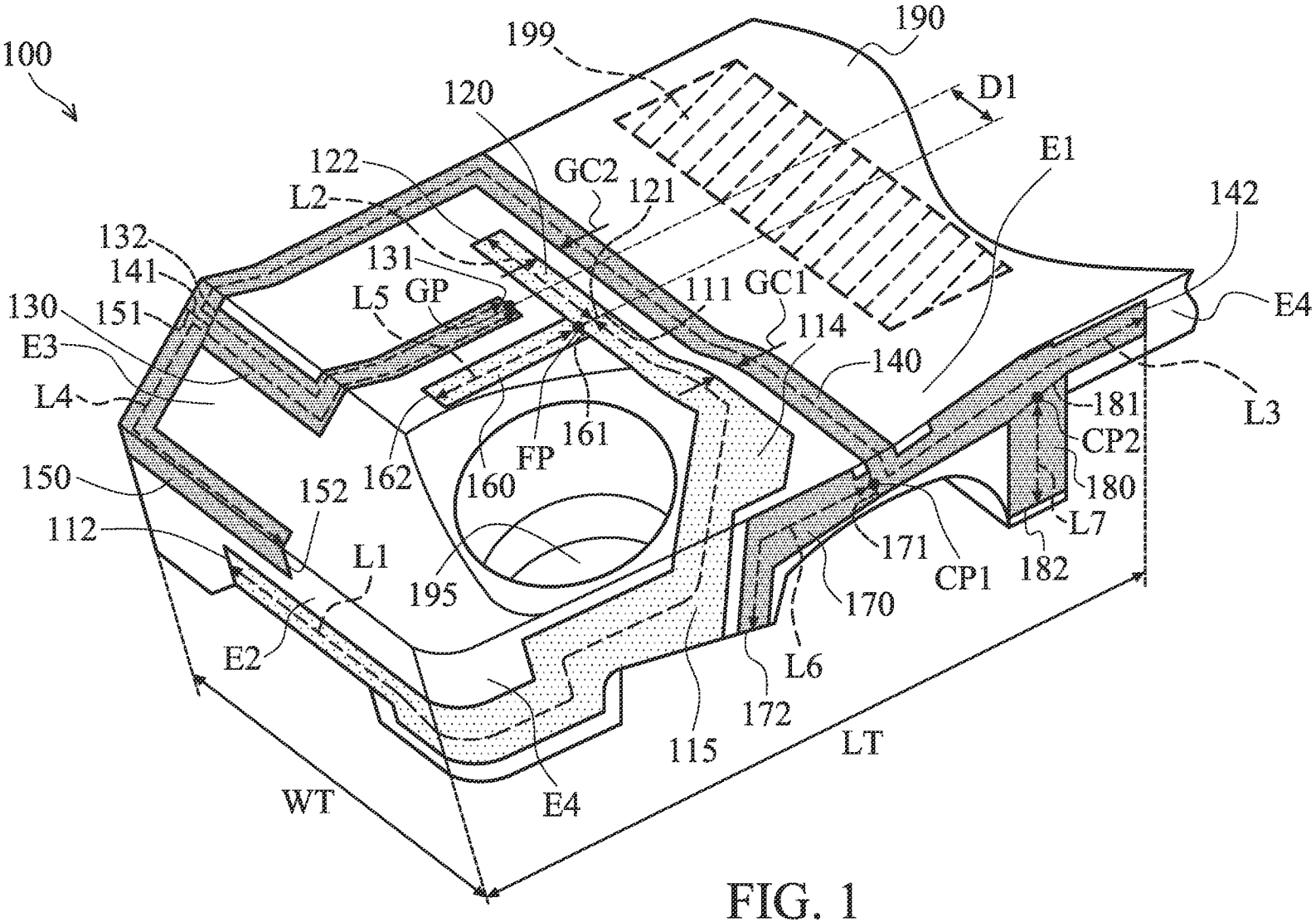
FIG. 1 is a perspective view of an antenna structure according to an embodiment of the invention.

In order to illustrate the purposes, features and advantages of the invention, the embodiments and figures of the invention are shown in detail below.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Furthermore, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

FIG. 1 is a perspective view of an antenna structure 100 according to an embodiment of the invention. The antenna structure 100 may be applied to a mobile device, such as a joystick, a smartphone, a tablet computer, or a notebook computer. In the embodiment of FIG. 1, the antenna structure 100 at least includes a first radiation element 110, a second radiation element 120, a third radiation element 130, a fourth radiation element 140, a fifth radiation element 150, and a nonconductive support element 190. The first radiation element 110, the second radiation element 120, the third radiation element 130, the fourth radiation element 140, and the fifth radiation element 150 may all be made of metal materials, such as silver, copper, aluminum, iron, or their alloys.

The nonconductive support element 190 may be a 3D (Three-Dimensional) structure with a first surface E1, a second surface E2, a third surface E3, and a fourth surface E4. For example, the second surface E2 and the fourth surface E4 may be next to each other, and they may both be substantially perpendicular to the first surface E1. In addition, the third surface E3 may be connected between the first surface E1 and the second surface E2. The third surface E3 may be neither parallel nor perpendicular to the first surface E1 and the second surface E2. The first radiation element 110, the second radiation element 120, the third radiation element 130, the fourth radiation element 140, and the fifth radiation element 150 are distributed over the first surface E1, the second surface E2, the third surface E3, and the fourth surface E4 of the nonconductive support element 190. In some embodiments, the nonconductive support element 190 further has an opening 195, which may be substantially circular. A variety of electronic elements may pass through the opening 195. For example, the aforementioned electronic element may be a metal connection element or a circuit element. However, the invention is not limited thereto. In alternative embodiments, the opening 195 may be filled or removed from the nonconductive support element 190. In some embodiments, the first radiation element 110, the second radiation element 120, the third radiation element 130, the fourth radiation element 140, and the fifth radiation element 150 are all disposed on the nonconductive support element 190 by using LDS (Laser Direct Structuring) technology.

The first radiation element 110 may substantially have a U-shape, which may extend from the first surface E1 through the fourth surface E4 onto the second surface E2 of the nonconductive support element 190. Specifically, the first radiation element 110 has a first end 111 and a second end 112. A feeding point FP is positioned at the first end 111 of the first radiation element 110. The second end 112 of the first radiation element 110 is an open end. The feeding point FP may be further coupled to a signal source (not shown). For example, the aforementioned signal source may be an RF (Radio Frequency) module for exciting the antenna structure 100. In some embodiments, the first radiation element 110 is a variable-width structure, and includes a first widening portion 114 and a second widening portion 115 which are coupled to each other. However, the invention is not limited thereto. In alternative embodiments, adjustments may be made so that the first radiation element 110 is an equal-width structure.

The second radiation element 120 may substantially have a straight-line shape, which may be disposed on the first surface E1 of the nonconductive support element 190. Specifically, the second radiation element 120 has a first end 121 and a second end 122. The first end 121 of the second radiation element 120 is coupled to the feeding point FP. The second end 122 of the second radiation element 120 is an open end. The second end 122 of the second radiation element 120 and the second end 112 of the first radiation element 110 may substantially extend in the same direction.

The third radiation element 130 may substantially have an L-shape, which may extend from the first surface E1 onto the third surface E3 of the nonconductive support element 190. Specifically, the third radiation element 130 has a first end 131 and a second end 132. A grounding point GP is positioned at the first end 131 of the third radiation element 130. The grounding point GP may be further coupled to a system ground plane (not shown) of the antenna structure 100.

The fourth radiation element 140 may be a meandering structure, which may extend from the third surface E3 through the first surface E1 onto the fourth surface E4. Specifically, the fourth radiation element 140 has a first end 141 and a second end 142. The first end 141 of the fourth radiation element 140 is coupled to the second end 132 of the third radiation element 130. The second end 142 of the fourth radiation element 140 is an open end. The fourth radiation element 140 is adjacent to the first radiation element 110 and the second radiation element 120. It should be noted that the term "adjacent" or "close" over the disclosure means that the distance (spacing) between two corresponding elements is shorter than a predetermined distance (e.g., 5 mm or shorter), but often it does not mean that the two corresponding elements are touching each other directly (i.e., the aforementioned distance/spacing therebetween is reduced to 0). In some embodiments, a first coupling gap GC1 is formed between the fourth radiation element 140 and the first radiation element 110, and a second coupling gap GC2 is formed between the fourth radiation element 140 and the second radiation element 120.

The fifth radiation element 150 may substantially have an L-shape, which may extend from the third surface E3 onto the second surface E2 of the nonconductive support element 190. Specifically, the fifth radiation element 150 has a first end 151 and a second end 152. The first end 151 of the fifth radiation element 150 is coupled to the second end 132 of the third radiation element 130 and the first end 141 of the fourth radiation element 140. The second end 152 of the fifth radiation element 150 is an open end, which is adjacent to the second end 112 of the first radiation element 110. The second end 152 of the fifth radiation element 150 and the second end 122 of the second radiation element 120 may substantially extend in opposite directions.

In some embodiments, the antenna structure 100 further includes a sixth radiation element 160. The sixth radiation element 160 may substantially have a straight-line shape, which may be disposed on the first surface E1 of the nonconductive support element 190. Specifically, the sixth radiation element 160 has a first end 161 and a second end 162. The first end 161 of the sixth radiation element 160 is coupled to the feeding point FP. The second end 162 of the sixth radiation element 160 is an open end. The sixth radiation element 160 may be substantially perpendicular to the first radiation element 110 and the second radiation element 120. It should be understood that the sixth radiation element 160 is an optional element, which is removable from the antenna structure 100 in other embodiments.

In some embodiments, the antenna structure 100 further includes a seventh radiation element 170. The seventh radiation element 170 may substantially have an L-shape, which may be disposed on the fourth surface E4 of the nonconductive support element 190. Specifically, the seventh radiation element 170 has a first end 171 and a second end 172. The first end 171 of the seventh radiation element 170 is coupled to a first connection point CP1 on the fourth radiation element 140. The second end 172 of the seventh radiation element 170 is an open end, which is adjacent to the first widening portion 114 and the second widening portion 115 of the first radiation element 110. It should be understood that the seventh radiation element 170 is an optional element, which is removable from the antenna structure 100 in other embodiments.

In some embodiments, the antenna structure 100 further includes an eighth radiation element 180. The eighth radiation element 180 may substantially have a straight-line shape, which may be disposed on the fourth surface E4 of the nonconductive support element 190. Specifically, the eighth radiation element 180 has a first end 181 and a second end 182. The first end 181 of the eighth radiation element 180 is coupled to a second connection point CP2 on the fourth radiation element 140. The second end 182 of the eighth radiation element 180 is an open end. The second connection point CP2 is different from the first connection point CP1. The eighth radiation element 180 may be substantially perpendicular to the fourth radiation element 140. It should be understood that the eighth radiation element 180 is an optional element, which is removable from the antenna structure 100 in other embodiments.

Figure 2:
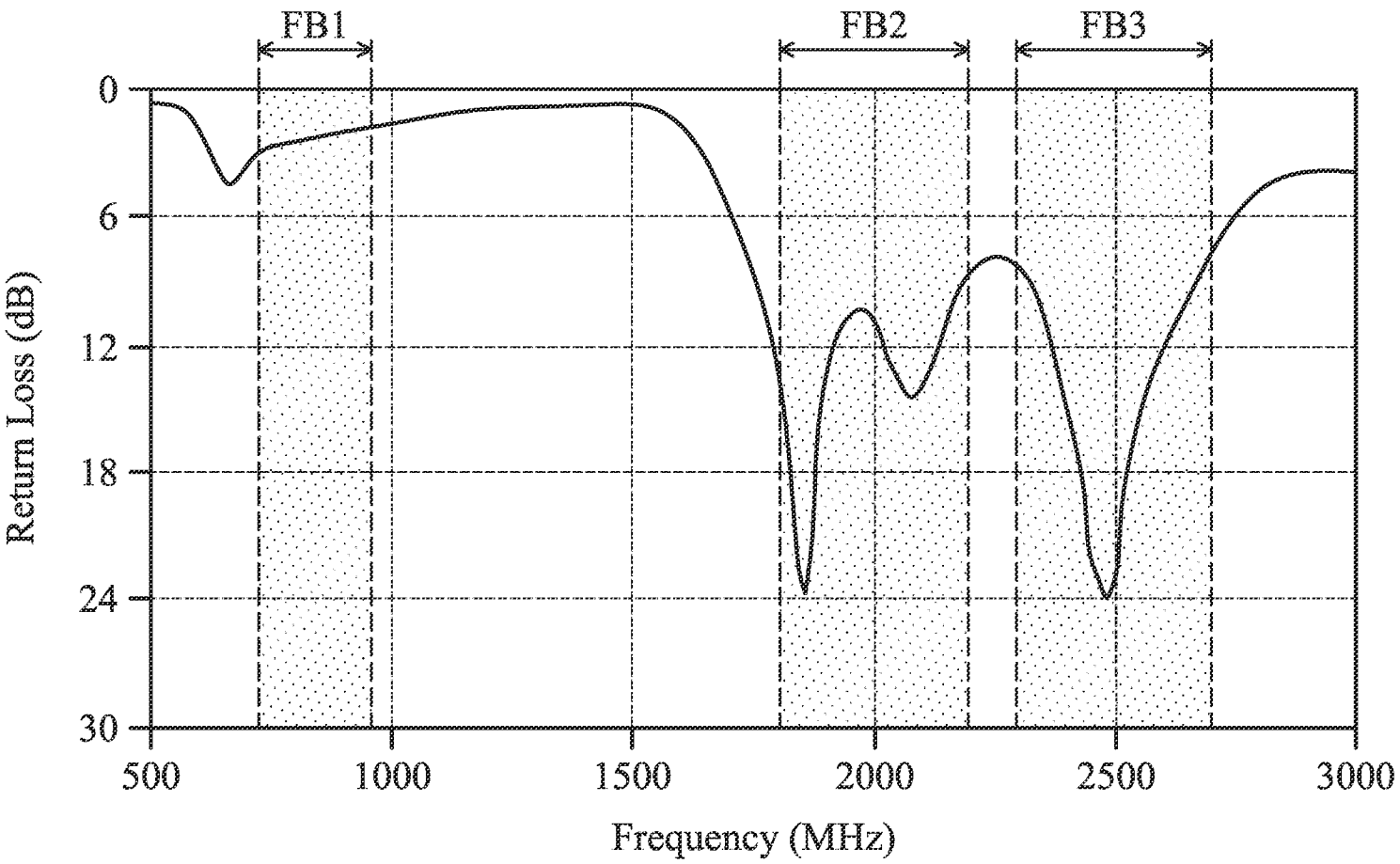
FIG. 2 is a diagram of return loss of an antenna structure according to an embodiment of the invention.

FIG. 2 is a diagram of return loss of the antenna structure 100 according to an embodiment of the invention. The horizontal axis represents the operation frequency (MHz), and the vertical axis represents the return loss (dB). According to the measurement of FIG. 2, the antenna structure 100 can cover a first frequency band FB1, a second frequency band FB2, and a third frequency band FB3. For example, the first frequency band FB1 may be from 728 MHz to 960 MHz, the second frequency band FB2 may be from 1805 MHz to 2200 MHz, and the third frequency band FB3 may be from 2300 MHz to 2690 MHz. Accordingly, the antenna structure 100 can support at least the wideband operations of Wi-Fi 2.4 GHz, LTE (Long Term Evolution), and 5G ($5^{th}$ Generation Mobile Networks) communication of the next generation.

With respect to the antenna theory, the third radiation element 130 and the fourth radiation element 140 are excited by the first radiation element 110 using a coupling mechanism, thereby forming the aforementioned first frequency band FB1. The third radiation element 130 and the fifth radiation element 150 are excited by the first radiation element 110 and the fourth radiation element 140 using a coupling mechanism, thereby forming the aforementioned second frequency band FB2. The second radiation element 120 is independently excited, thereby forming the aforementioned third frequency band FB3. It should be understood that the double-frequency effect of the excitations of the first radiation element 110, the third radiation element 130, and the fourth radiation element 140 also contributes to the generation of the second frequency band FB2 and the third frequency band FB3. According to practical measurements, the incorporation of the sixth radiation element 160 helps to fine-tune the impedance matching of the second frequency band FB2, and the incorporation of the seventh radiation element 170 and the eighth radiation element 180 helps to fine-tune the impedance matching of the first frequency band FB1. In addition, the first widening portion 114 and the second widening portion 115 of the first radiation element 110 can increase the operation bandwidth of the first frequency band FB1.

Figure 3:
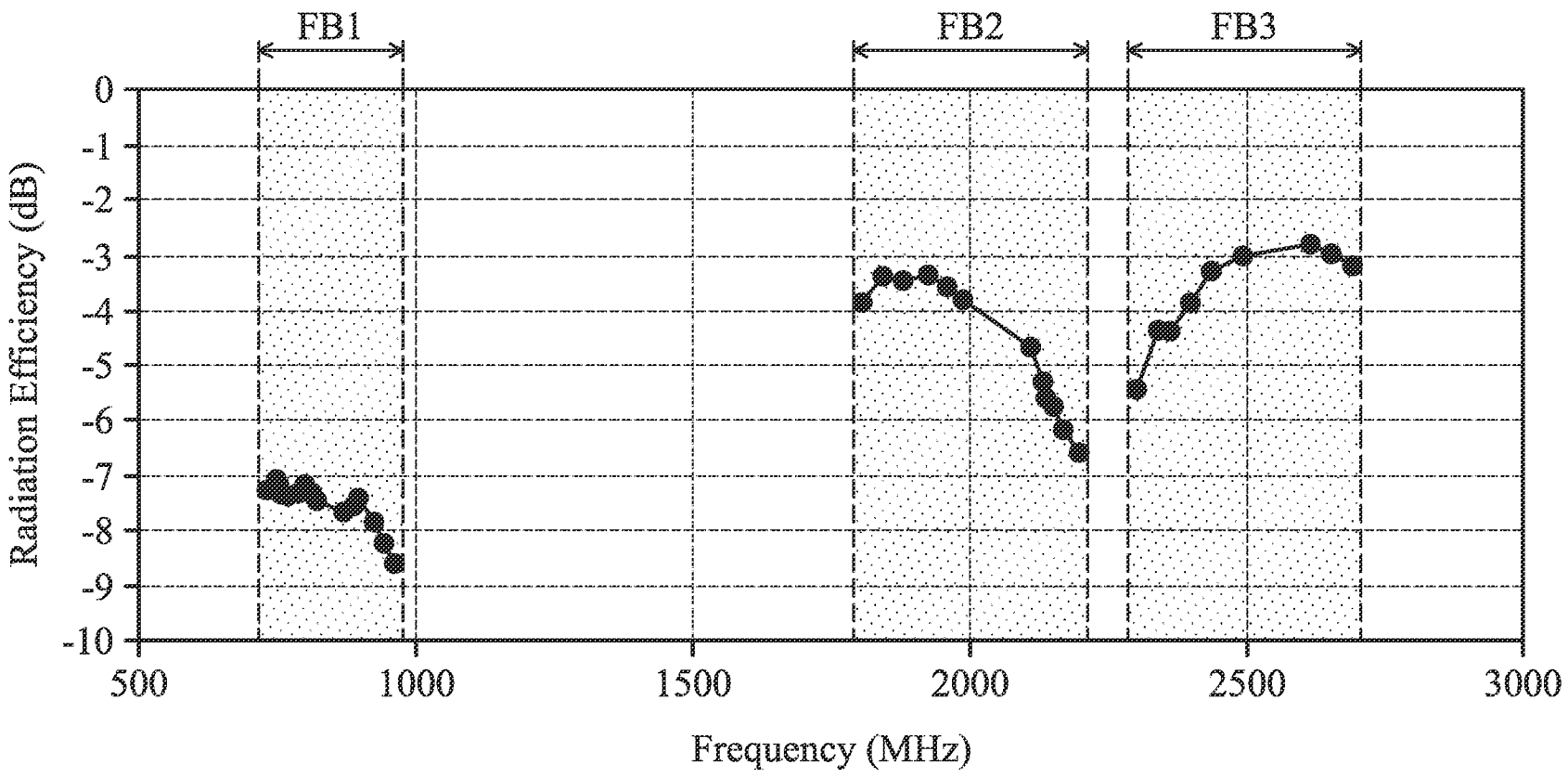
FIG. 3 is a diagram of radiation efficiency of an antenna structure according to an embodiment of the invention.

FIG. 3 is a diagram of radiation efficiency of the antenna structure 100 according to an embodiment of the invention. The horizontal axis represents the operation frequency (MHz), and the vertical axis represents the radiation efficiency (dB). According to the measurement of FIG. 3, the radiation efficiency of the antenna structure 100 is higher than −9 dB within the first frequency band FB1, the second frequency band FB2, and the third frequency band FB3 as mentioned above, and it can meet the requirements of practical application of general mobile communication devices.

In some embodiments, the element sizes and element parameters of the antenna structure 100 are described as follows. The length L1 of the first radiation element 110 may be from 0.1 to 0.2 wavelength (0.1λ~0.2λ) of the highest frequency of the first frequency band FB1 of the antenna structure 100; e.g., about 0.17 wavelength (0.17λ). The length L2 of the second radiation element 120 may be from 0.05 to 0.2 wavelength (0.05λ~0.2λ) of the highest frequency of the third frequency band FB3 of the antenna structure 100; e.g., about 0.15 wavelength (0.15λ). The total length L3 of the third radiation element 130 and the fourth radiation element 140 may be from 0.1 to 0.2 wavelength (0.1λ~0.2λ) of the lowest frequency of the first frequency band FB1 of the antenna structure 100; e.g., about 0.15 wavelength (0.15λ). The total length L4 of the third radiation element 130 and the fifth radiation element 150 may be from 0.1 to 0.3 wavelength (0.1λ~0.3λ) of the lowest frequency of the second frequency band FB2 of the antenna structure 100; e.g., about 0.2 wavelength (0.2λ). The length L5 of the sixth radiation element 160 may be from 5 mm to 9 mm; e.g., about 7 mm. The length L6 of the seventh radiation element 170 may be from 8 mm to 12 mm; e.g., about 10 mm. The length L7 of the eighth radiation element 180 may be from 4 mm to 6 mm; e.g., about 5 mm. The width of the first coupling gap GC1 may be from 0.1 mm to 1 mm; e.g., about 0.5 mm. The width of the second coupling gap GC2 may be from 0.1 mm to 1 mm; e.g., about 0.5 mm. The distance D1 between the feeding point FP and the grounding point GP may be from 1 mm to 2 mm; e.g., about 1.5 mm. The total length LT of the antenna structure 100 may be about 28 mm, and the total width WT of the antenna structure 100 may be about 14 mm. The above ranges of element sizes and element parameters are calculated and obtained according to many experiment results, and they help to optimize the operation bandwidth and the impedance matching of the antenna structure 100.

In alternative embodiments, the antenna structure 100 is adjacent to an NFC (Near-Field Communication) antenna 199 (which is another independent antenna, and is not a portion of the antenna structure 100). According to practical measurements, if the NFC antenna 199 is disposed inside a non-metal region next to the fourth radiation element 140, it does not negatively affect the radiation performance of the antenna structure 100 so much. Therefore, the design of the antenna structure 100 can help to minimize the total antenna size.

The invention proposes a novel antenna structure. In comparison to the conventional technology, the invention has at least the advantages of small size, wide bandwidth, low manufacturing cost, and adapting to different use environments, and therefore it is suitable for application in a variety of mobile communication devices.

Note that the above element sizes, element shapes, element parameters, and frequency ranges are not limitations of the invention. An antenna designer can fine-tune these settings or values according to different requirements. It should be understood that the antenna structure of the invention is not limited to the configurations of FIGS. 1-3. The invention may merely include any one or more features of any one or more embodiments of FIGS. 1-3. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna structure, comprising:

a first radiation element, having a feeding point;

a second radiation element, coupled to the feeding point;

a third radiation element, having a grounding point;

a fourth radiation element, coupled to the third radiation element, wherein the fourth radiation element is adjacent to the first radiation element and the second radiation element;

a fifth radiation element, coupled to the third radiation element and the fourth radiation element; and a nonconductive support element, wherein the first radiation element, the second radiation element, the third radiation element, the fourth radiation element, and the fifth radiation element are disposed on the nonconductive support element;

wherein the antenna structure covers a first frequency band;

wherein a length of the first radiation element is from 0.1 to 0.2 wavelength of the highest frequency of the first frequency band.

2. The antenna structure as claimed in claim 1, wherein the antenna structure further covers a second frequency band and a third frequency band, the first frequency band is from 728 MHz to 960 MHz, the second frequency band is from 1805 MHz to 2200 MHz, and the third frequency band is from 2300 MHz to 2690 MHz.

3. The antenna structure as claimed in claim 1, wherein the first radiation element substantially has a U-shape.

4. The antenna structure as claimed in claim 1, wherein the first radiation element is a variable-width structure and comprises a first widening portion and a second widening portion.

5. The antenna structure as claimed in claim 1, wherein the second radiation element substantially has a straight-line shape.

6. The antenna structure as claimed in claim 2, wherein a length of the second radiation element is from 0.05 to 0.2 wavelength of the highest frequency of the third frequency band.

7. The antenna structure as claimed in claim 1, wherein the third radiation element substantially has an L-shape.

8. The antenna structure as claimed in claim 1, wherein the fourth radiation element is a meandering structure.

9. The antenna structure as claimed in claim 1, wherein a first coupling gap is formed between the fourth radiation element and the first radiation element, and a width of the first coupling gap is from 0.1 mm to 1 mm.

10. The antenna structure as claimed in claim 1, wherein a second coupling gap is formed between the fourth radiation element and the second radiation element, and a width of the second coupling gap is from 0.1 mm to 1 mm.

11. The antenna structure as claimed in claim 2, wherein a total length of the third radiation element and the fourth radiation element is from 0.1 to 0.2 wavelength of the lowest frequency of the first frequency band.

12. The antenna structure as claimed in claim 1, wherein the fifth radiation element substantially has an L-shape.

13. The antenna structure as claimed in claim 2, wherein a total length of the third radiation element and the fifth radiation element is from 0.1 to 0.3 wavelength of the lowest frequency of the second frequency band.

14. The antenna structure as claimed in claim 1, further comprising:

a sixth radiation element, coupled to the feeding point, wherein the sixth radiation element is substantially perpendicular to the first radiation element and the second radiation element.

15. The antenna structure as claimed in claim 14, wherein the sixth radiation element substantially has a straight-line shape.

16. The antenna structure as claimed in claim 4, further comprising:

a seventh radiation element, coupled to a first connection point on the fourth radiation element, wherein the seventh radiation element is adjacent to the first widening portion and the second widening portion of the first radiation element.

17. The antenna structure as claimed in claim 16, wherein the seventh radiation element substantially has an L-shape.

18. The antenna structure as claimed in claim 16, further comprising:

an eighth radiation element, coupled to a second connection point on the fourth radiation element, wherein the eighth radiation element is substantially perpendicular to the fourth radiation element.

19. The antenna structure as claimed in claim 18, wherein the first radiation element, the second radiation element, the third radiation element, the fourth radiation element, and the fifth radiation element are disposed on the nonconductive support element by using LDS (Laser Direct Structuring) technology.

* * * * *